US009717977B2

(12) United States Patent
De Loore et al.

(10) Patent No.: US 9,717,977 B2
(45) Date of Patent: Aug. 1, 2017

(54) SLIDING DEVICE FOR SLIDING ON SNOW

(71) Applicant: HANNES SOFTWARE ENGINEERING B.V.B.A., Antwerp (BE)

(72) Inventors: Roel Frans Lodewijk De Loore, Hamme (BE); Kristof Geilenkotten, Antwerp (BE); Isabelle Decroos, Bornem (BE); Emily Geilenkotten, Antwerp (BE); Charlotte Geilenkotten, Antwerp (BE)

(73) Assignee: HANNES SOFTWARE ENGINEERING B.V.B.A., Antwerp (BE)

( * ) Notice: Subject to any disclaimer, the term of this patent is extended or adjusted under 35 U.S.C. 154(b) by 0 days.

(21) Appl. No.: 15/266,316

(22) Filed: Sep. 15, 2016

(65) Prior Publication Data

US 2017/0095724 A1 Apr. 6, 2017

(30) Foreign Application Priority Data

Oct. 2, 2015 (BE) ..... 2015/5613

(51) Int. Cl.

| | |
|---|---|
| ***B62B 13/12*** | (2006.01) |
| ***B62B 13/10*** | (2006.01) |
| ***A63C 5/03*** | (2006.01) |
| ***A63C 5/06*** | (2006.01) |

(52) U.S. Cl.

CPC ..... *A63C 5/031* (2013.01); *A63C 5/06* (2013.01)

(58) Field of Classification Search

CPC ..... B62B 17/068; B62B 13/10; B62B 13/12
See application file for complete search history.

(56) References Cited

U.S. PATENT DOCUMENTS 1,600,735 A * 9/1926 Pederson ..... B62B 13/12 280/21.1
2,547,210 A * 4/1951 Holbrook ..... B62B 13/125 280/22.1
2,666,652 A * 1/1954 Lammers ..... B62B 13/12 280/22.1

(Continued)

FOREIGN PATENT DOCUMENTS

DE 36 28 111 A1 3/1988
WO 2010/136034 A2 12/2010

OTHER PUBLICATIONS

BE Search Report, dated May 31, 2016, from corresponds BE application.

*Primary Examiner* — Bryan Evans
(74) *Attorney, Agent, or Firm* — Young & Thompson

(57) ABSTRACT

Sliding device (1) for sliding on snow, whereby the sliding device (1) includes at least two skis (2) that extend in a longitudinal direction (L), whereby the at least two skis (2) are mounted next to one another and parallel to one another, whereby the at least two skis (2) are tiltable around separate horizontal axes of rotation (H) that are parallel to the longitudinal direction of the skis (2), whereby the sliding device (1) includes at least one support (7) that is rotatable around a vertical shaft (9), whereby the sliding device (1) is provided with a transmission (10, 11, 12) to convert a rotation movement of the support (7) around the vertical shaft (9) into a tilting movement of the skis (2) around their respective axes of rotation (H).

3 Claims, 4 Drawing Sheets

(56) References Cited

U.S. PATENT DOCUMENTS

| | | | | |
|---|---|---|---|---|
| 4,542,908 | A * | 9/1985 | Muyskens | B62B 13/12 280/22.1 |
| 4,647,062 | A | 3/1987 | Mcdougall | |
| 5,558,354 | A | 9/1996 | Lion | |
| 6,113,115 | A | 9/2000 | Hurth | |
| 6,530,582 | B2 * | 3/2003 | Dempster | B62B 13/12 280/16 |

* cited by examiner

SLIDING DEVICE FOR SLIDING ON SNOW

FIELD OF THE INVENTION

The present invention relates to a sliding device for sliding on snow.

More specifically the invention is intended as a replacement or supplement for the known skis, snowboards and other sliding devices for sports use on snow.

BACKGROUND OF THE INVENTION

In the case of a single sliding body, such as a snowboard, this presents the problem that there is only one side edge that grips in the snow when making a turn so that only relatively small forces can be exerted on the snowboard by the snow, such that fast sharp turns are difficult to make.

When using a pair of skis there are of course two such edges so that this is less of a problem. Hereby the user has to be well trained to keep the skis parallel.

Various mechanisms are known to keep a number of skis parallel and/or to tilt them together, for example in U.S. Pat. No. 6,113,115, DE 3628111 and WO2010/136034. However, here the user always to make a tilting movement around a horizontal axis to make the skis tilt.

This is not always easy because either the lower legs of the user have to take up this tilting or the centre of gravity of the user is no longer above the skis so that an intrinsically unstable position is obtained.

SUMMARY OF THE INVENTION

The invention provides a sliding device for sliding on snow, whereby the sliding device comprises at least two skis that extend in a longitudinal direction, whereby the at least two skis are mounted next to one another and parallel to one another, whereby the at least two skis are tiltable around separate horizontal axes of rotation that are parallel to the longitudinal axes of the skis, whereby the sliding device comprises at least one support for the feet of a user of the sliding device, whereby at least one support is rotatable around a vertical shaft, whereby the sliding device is provided with a transmission to convert a rotation movement of the support around the said vertical shaft into a tilting movement of the skis around their respective axes of rotation.

The support or supports are of course generally foot supports, intended and suitable for the feet of the user.

Another use of the sliding device, for example sitting on a support, is not excluded however.

Hereby the said horizontal and vertical axes are horizontal and vertical respectively when the sliding device is on a horizontal surface with the skis in an untilted position.

Hereby the geometric extension of the vertical axis preferably runs through the at least one support.

The sliding device has the advantage that the centre of gravity of the user is always, or in any case in many more situations than with the traditional sliding devices, above the skis, without the ankles of the user being loaded by a tilting movement.

It has also turned out that with regard to the necessary movements, such a sliding device is very similar to a longboard, a variant of skateboards in which extra long skateboards are used. As a result, for longboard practitioners it is much easier to do winter sports with the sliding device according to the invention than with the traditional sliding devices.

In a preferred embodiment, the sliding device comprises at least three of the said skis. As a result, the edge length that can be used for turns is increased, and therefore the turning circle that can be attained at a given speed is reduced.

In order to obtain a symmetrical behaviour, the transmission is constructed such that a tilting movement of the at least two skis is only possible in the same direction and over the same angle.

To prevent variations in the movements of the user leading to unstable sliding behaviour, the sliding device, in particular the transmission, is constructed such that only a rotation movement around the said vertical axis, and no other movement, of the at least one support with respect to the at least two skis is possible.

In a further preferred embodiment the transmission comprises a control rod that is eccentrically coupled to the at least one support and which converts a rotation movement of the at least one support into a sideways translation movement, whereby the control rod is connected to at least one of the at least two skis to make it tilt. This is a practical way of implementing the transmission.

Hereby the control rod is preferably coupled to the front or back of the at least one support to thereby obtain a sideways movement and not a forward or backward movement of the control rod.

In another preferred embodiment the at least two skis are connected by at least two bridges on which the at least two skis are tiltably mounted, whereby the at least one support is mounted on a said bridge. In this way a sturdy stable construction is obtained.

In a preferred embodiment the transmission is such that a rotation of both supports independently of one another is possible.

This means that the different supports can be turned to different extents or even in different directions, so that as a result the skis can be twisted and sharper turns can be made.

Of course the level of independence of the rotation of the two foot supports depends on the stiffness of the skis and the strength of the user.

Preferably the sliding device has no other skis than the said at least two skis, and viewed along their length the skis are made of one part, i.e. they do not have a hinge point to allow a front part of a ski to freely hinge with respect to a back part of this ski.

In a further preferred embodiment the transmission is such that a rotation movement of the at least one support around the said vertical axis over a number of degrees leads to a tilting movement of the at least two skis between 0.1 and 2.0 times that number of degrees, and preferably between 0.2 and 1.2 times that number of degrees.

It has turned out that such a transmission gives a good balance between the force that the user has to deliver to obtain a certain tilting movement of the skis, and the distance over which the user must rotate his feet to obtain this certain tilting movement.

BRIEF DESCRIPTION OF THE DRAWINGS

With the intention of better showing the characteristics of the invention a few preferred embodiments of a sliding device according to the invention are described hereinafter by way of an example, without any limiting nature, with reference to the accompanying drawings, wherein.

DETAILED DESCRIPTION OF THE INVENTION

The sliding device 1 shown in FIGS. 1 to 4 comprises three parallel skis of equal length. The skis have a front 3 and a back 4. The skis extend in a longitudinal direction L from the back 4 to the front 3.

Figure 1:
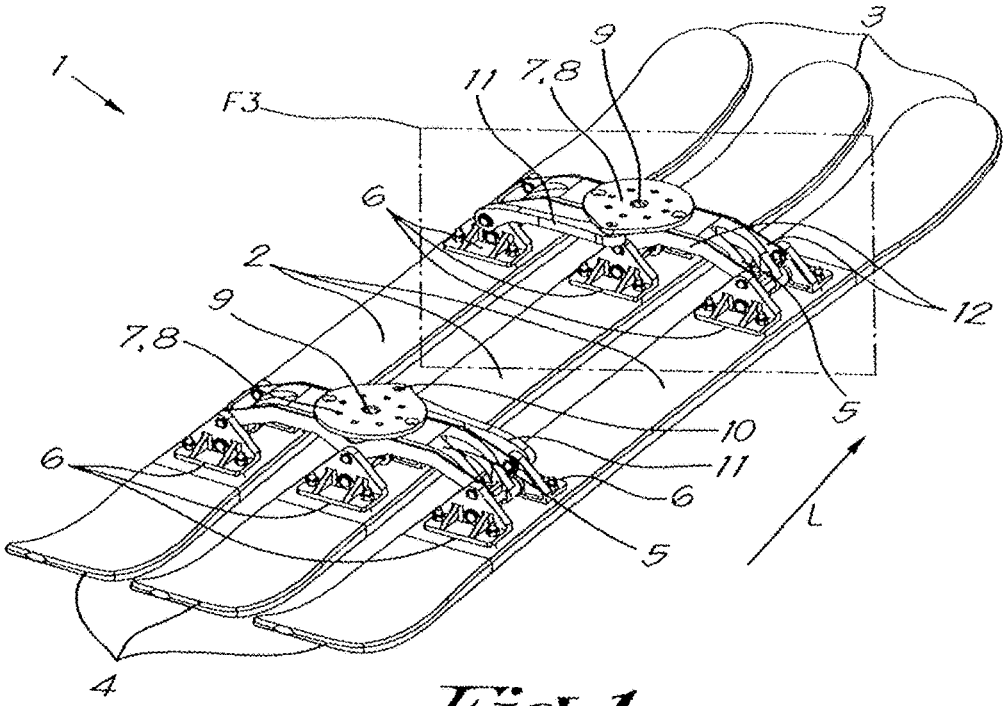
FIG. 1 schematically shows a perspective view of the sliding device according to the invention in a first usage position.
Figure 2:
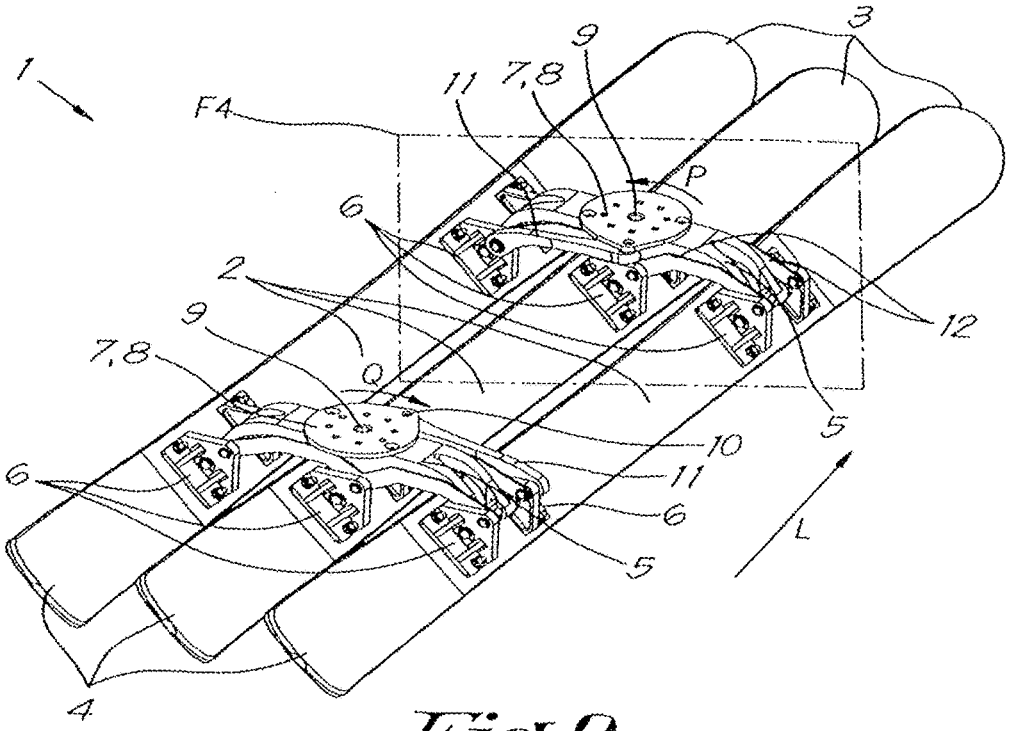
FIG. 2 schematically shows a perspective view of the sliding device of FIG. 1 in a different usage position.
Figure 3:
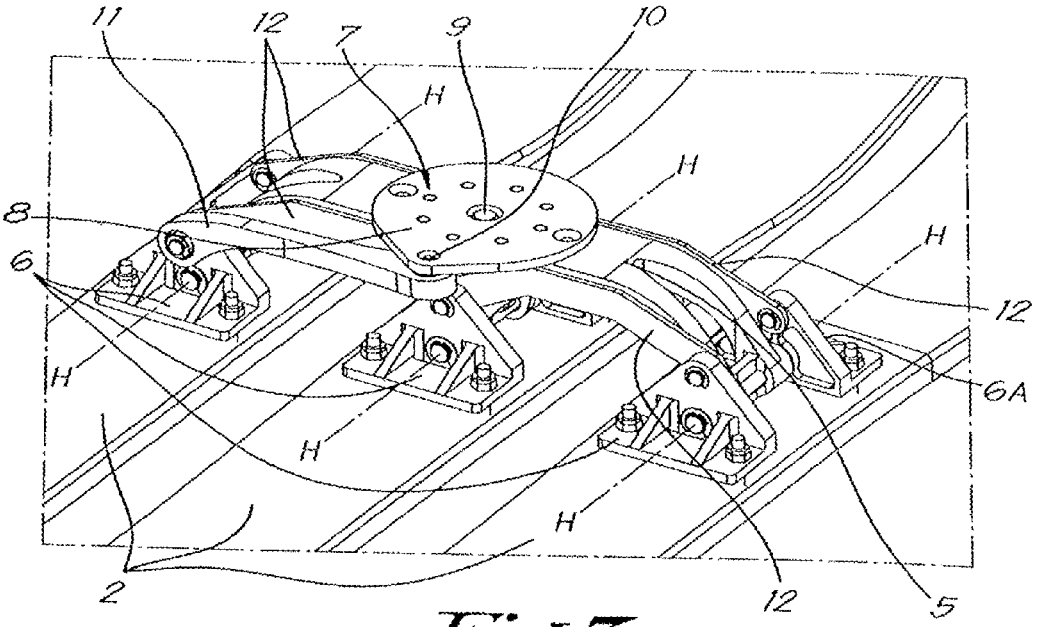
FIG. 3 shows the part indicated by F3 in FIG. 1 on a larger scale.
Figure 4:
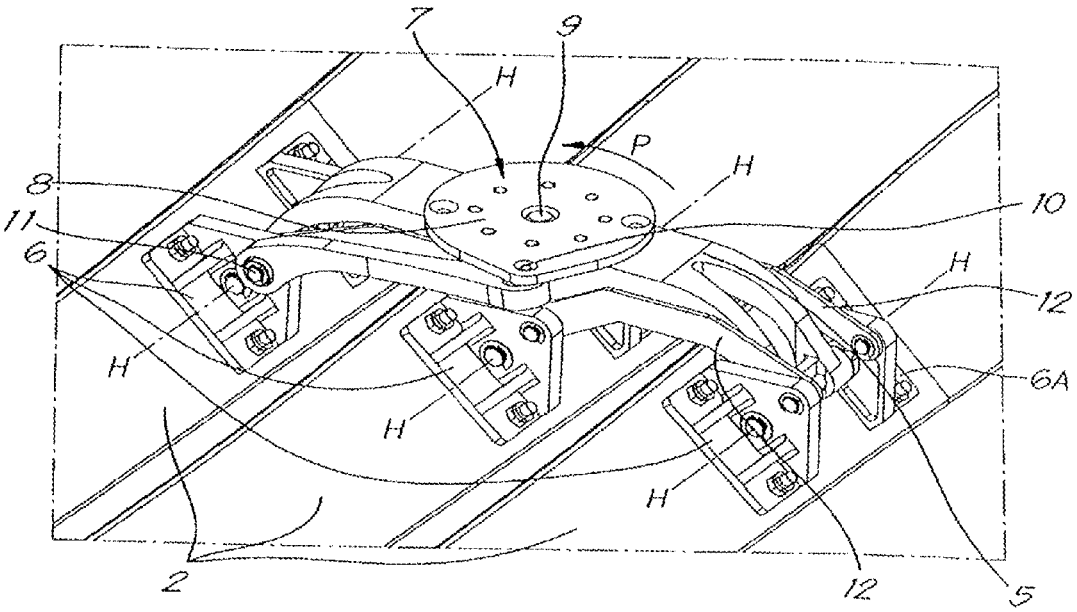
FIG. 4 shows the part indicated by F4 in FIG. 1 on a larger scale.
Figure 5:
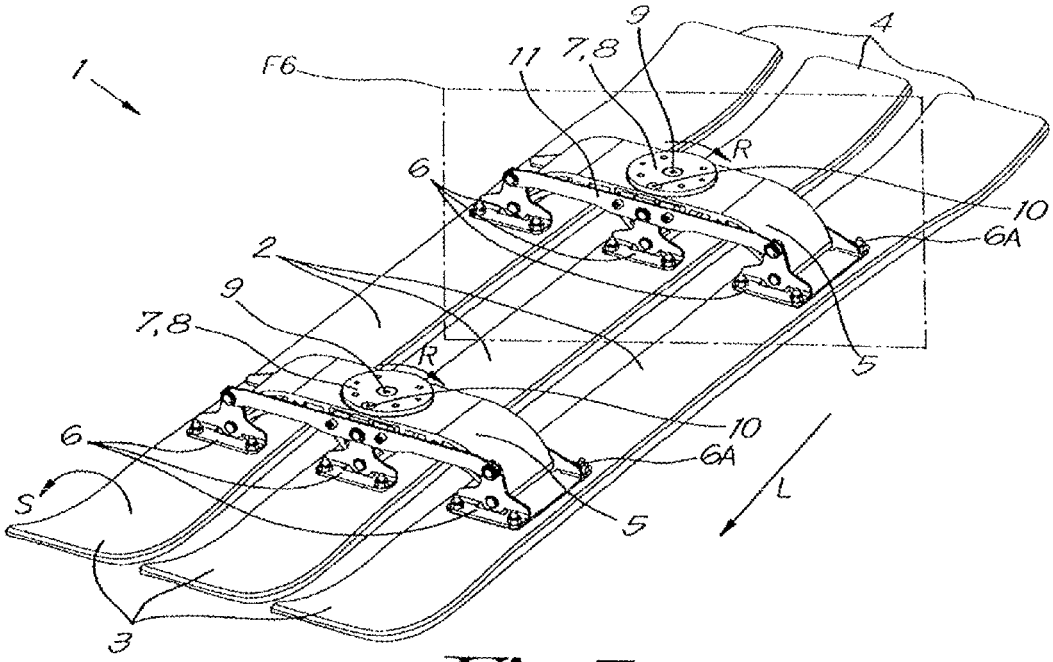
FIG. 5 schematically shows a perspective view of an alternative embodiment of a sliding device according to the invention.
Figure 6:
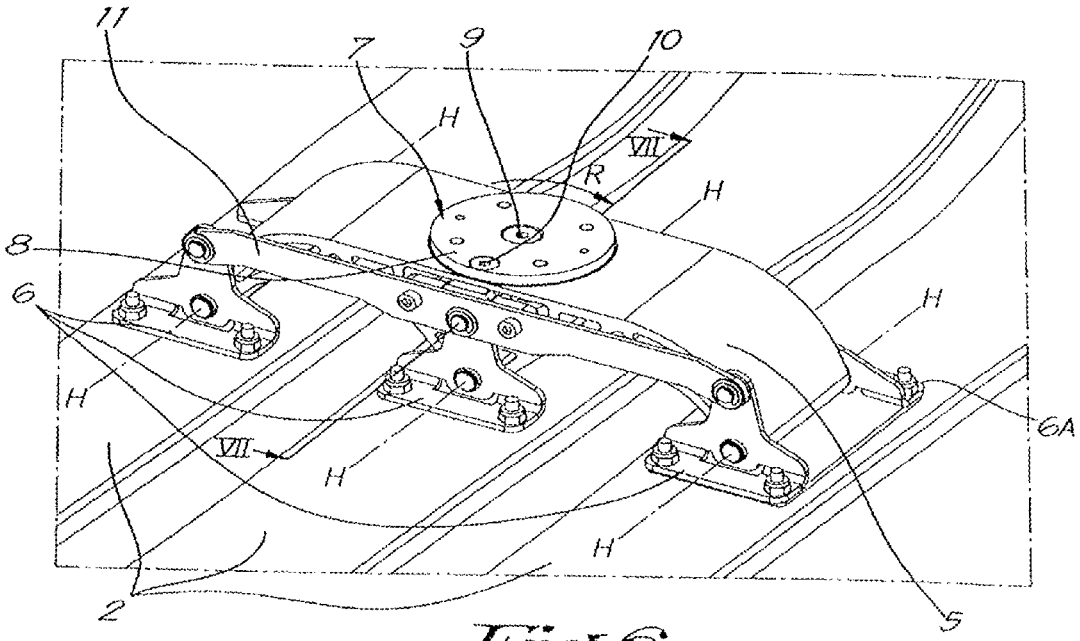
FIG. 6 shows the part indicated by F6 in FIG. 5 on a larger scale.
Figure 7:
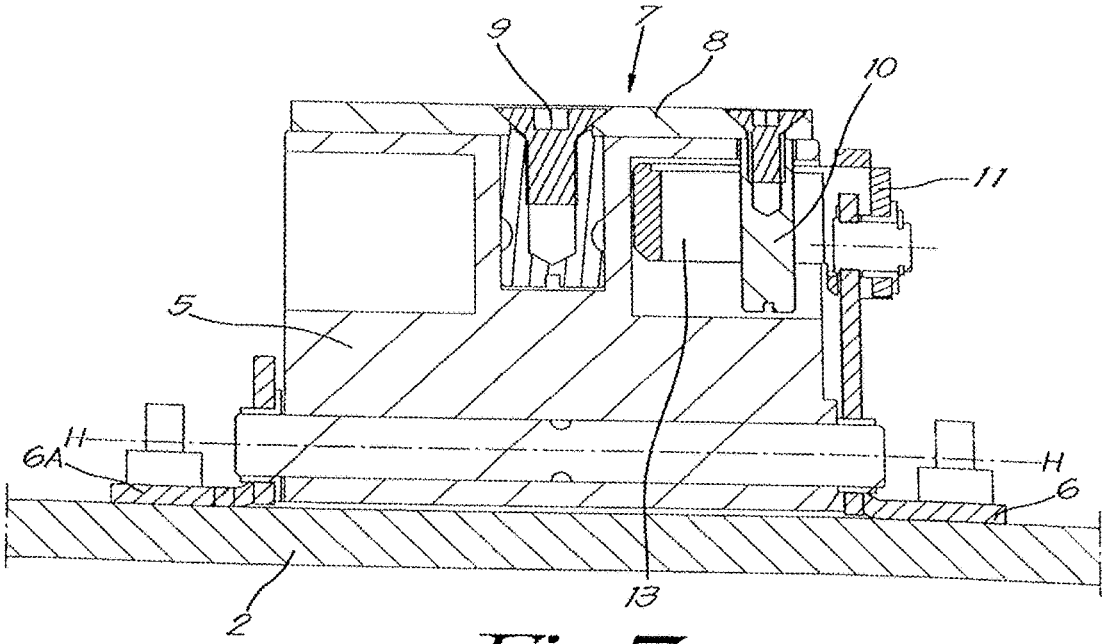
FIG. 7 shows a cross-section according to VII-VII of a part of the sliding device of FIGS. 5 and 6.
Figure 8:
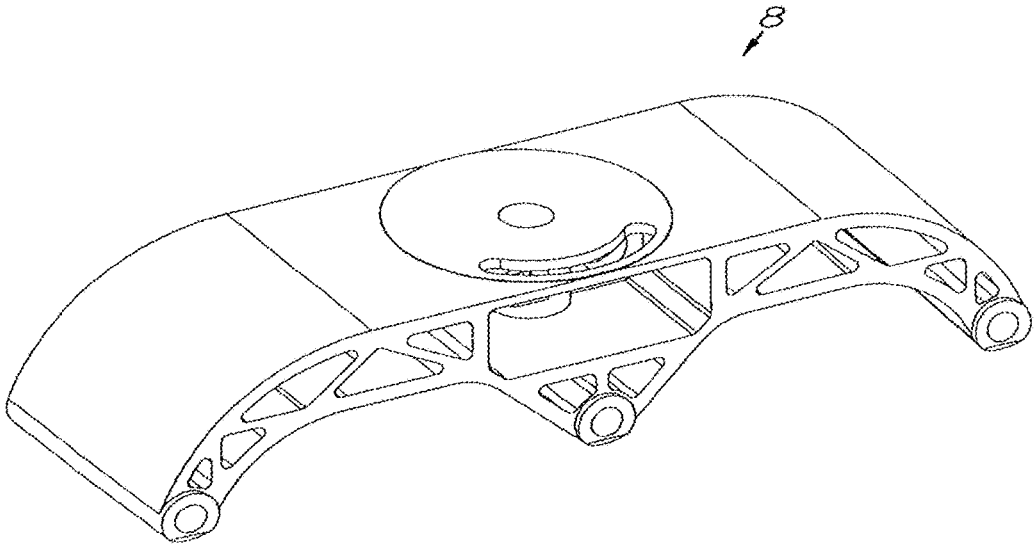
FIG. 8 shows a component of the alternative embodiment of FIGS. 5 and 6.

In FIGS. 1 and 3, the sliding device is in the neutral position, as it would be on a flat surface, and in FIGS. 2 and 4 in a non-neutral position such as occurs during the use of the sliding device 1.

The skis 2 are mounted next to one another in parallel by means of two bridges 5. In this example the bridges 5 are made of aluminium.

Triangular supports 6 are mounted on the skis in front of and behind the bridges 5. At a point near the skis 2 these supports 6 are rotatably mounted on the bridges 5, so that the skis 2 are tiltable with respect to the bridges 5, each around a separate axis of rotation H.

A foot support 7 is also affixed on each bridge 5. The foot support 7 is intended for the feet of the user to be placed thereon. To this end the foot support 7 can be provided with bindings to ensure a good connection with the feet of the user. However, such bindings are not shown in the drawings.

Each foot support 7 is constructed as a horizontal plate that, by means of a vertical shaft 9 affixed in the bridge 5 concerned, is rotatable around this vertical shaft 9 with respect to the bridge 5 concerned.

Each foot support 7 is coupled to the skis 2 by means of a transmission. This transmission essentially consists of a catch 10 on the underside of the plate 8 close to the edge, a control rod 11 and four synchronisation rods 12.

The control rod 11 is rotatably mounted on the catch 10 and is also rotatably mounted on the top of a support 6, in FIGS. 3 and 4, which show the front bridge 5 on the far left ski 2.

As can be seen in FIGS. 1 and 2, with the rear bridge 5 the control rod 11 of the transmission is mounted on the far right ski 2.

The synchronisation rods 12 are rotatably coupled to the tops of the supports 6, thus at a greater distance from the skis 2 than the axes of rotation H, and connect the supports together, whereby two synchronisation rods 12 are placed in front of the bridge 5 concerned and two synchronisation rods 12 behind the bridge 5 concerned.

In the embodiment of FIGS. 1 to 4 the catch 10 of the front foot support 7 is at the back of the foot support 7 and the catch 10 of the back foot support 7 is at the front of the foot support 7.

The use of the sliding device 1 is simple and as follows.

The user places the sliding device 1 in a neutral position, as shown in FIG. 1, on a snow-covered slope and connects his feet to the said foot supports 7, whereby the user adopts an essentially sideways position.

When the user now slides down the slope on the sliding device 1, he can control his sliding device by making the foot supports rotate 7.

In this embodiment the user has to turn his feet in a mutually opposite direction. This is illustrated in FIG. 2. Hereby the front foot support is turned anticlockwise 7, according to arrow P, and the back foot support 7 clockwise, according to arrow Q.

This turning of the foot supports 7 imposes a sideways movement on the control rods 11, which due to the fact that they are mounted on the top of the supports 6, thus above the axes of rotation H of the skis 2, causes a tilting movement of the skis 2.

Thanks to the synchronisation rods 12 a similar tilting movement is also imposed on the skis 2 that are not directly connected to the control rod 11 concerned.

In the example of FIG. 3 a tilting of the skis to the right, thus a deviation of the movement of the sliding device 1 to the right, is obtained.

The components 10, 11, 12 of the transmission are hereby such that a rotation movement of the foot supports 7 over a certain number of degrees causes the skis 2 to tilt over twice that number of degrees.

The alternative embodiment of FIGS. 5 to 8 differs from the above embodiment in the following aspects:

- The transmission is constructed differently, as will be explained below;
- The bridges 5 are made of plastic;
- The supports 6 that are mounted in front of and behind the bridges on the skis are mutually different: the supports 6A behind the bridges 5 do not have a transmission function but only for the tiltable suspension of the skis 2 and hence are made smaller.
- The two transmissions are identical so that the same turning movement of both feet of the user ensures a tilting of the skis 2.

The control rods 11 in the transmissions of the embodiment of FIGS. 5 to 8 are directly connected to the tops of the supports 6 that are in front of the bridges 5, such that separate synchronisation rods 12 can be omitted. This means that the control rods 11 in the second embodiment also fulfil the function of synchronisation rods 12.

The control rods 11 are self-driven because the catch 10 of the foot supports 7 is slidably affixed in a slot 13 running in the longitudinal direction of the skis. As a result, upon a turning movement of a foot support, which also constitutes a forward and backward movement of the catch 10 with respect to the bridge 5, this catch 10 will slide in this slot 13, and simultaneously give a sideways movement to the control rod 11.

The use of this alternative embodiment is similar to the embodiment described above, with the difference that the user must turn both feet in the same direction to obtain a tilting movement of the skis. This is illustrated with arrow R in FIG. 5, which shows a rotation of the foot supports, whereby this rotation causes a tilting of the skis in the direction of arrow S.

For the rest, the first embodiment can easily be converted into an embodiment in which both feet have to be turned in the same direction, simply by turning one of the bridges with the accompanying support and transmission components 180°. As a result, a similar functionality to the embodiment of FIGS. 5 to 8 is obtained, but with a different construction of the transmission of a rotation force from the foot supports to the skis.

The components 10, 11 of the transmission are hereby such that a rotation movement of the foot supports 7 over a certain number of degrees causes the skis 2 to tilt over approximately half that number of degrees.

The present invention is by no means limited to the embodiments described as an example and shown in the drawings, but a sliding device according to the invention can be realised in all kinds of forms and dimensions without departing from the scope of the invention.

The invention claimed is:

1. Sliding device for sliding on snow, whereby the sliding device (1) comprises at least two skis (2) that extend in a longitudinal direction (L), whereby the at least two skis (2) are mounted next to one another and parallel to one another, whereby the at least two skis (2) are tiltable around separate horizontal axes of rotation (H) that are parallel to the longitudinal direction of the skis (2), whereby the sliding device (1) comprises at least one support (7) that is rotatable around a vertical shaft (9), whereby the sliding device (1) is provided with a transmission (10, 11, 12) to convert a rotation movement of the support (7) around the vertical shaft (9) into a tilting movement of the skis (2) around their respective axes of rotation (H), wherein the at least two skis (2) are connected by at least one bridge (5) on which the at least two skis (2) are tiltably mounted, wherein the at least two skis (2) are connected by at least two said bridges (5), whereby the at least one support (7) is mounted on a said bridge (5), comprising two of the supports (7), whereby the supports (7), viewed in the longitudinal direction (L) of the skis (2), are mounted behind one another, whereby the supports (7) are each rotatable around a separate vertical shaft (9).

2. Sliding device according to claim 1, wherein each support (7) is mounted on a said bridge (5).

3. Sliding device according to claim 1, wherein the transmission (10, 11, 12) is such that a rotation of both supports (7) independently of one another is possible.

* * * * *